US009315956B2

(12) United States Patent
Heald

(10) Patent No.: US 9,315,956 B2
(45) Date of Patent: Apr. 19, 2016

(54) SECURITY BARRIER APPARATUS

(71) Applicant: Heald Technologies Ltd., Hornsea (GB)

(72) Inventor: Jonathan Roderick Heald, Hornsea (GB)

(73) Assignee: Heald Technologies Ltd., Hornsea (GB)

( * ) Notice: Subject to any disclaimer, the term of this patent is extended or adjusted under 35 U.S.C. 154(b) by 0 days.

(21) Appl. No.: 14/357,486

(22) PCT Filed: Oct. 31, 2012

(86) PCT No.: PCT/GB2012/000821
§ 371 (c)(1),
(2) Date: May 9, 2014

(87) PCT Pub. No.: WO2013/068711
PCT Pub. Date: May 16, 2013

(65) Prior Publication Data

US 2014/0314480 A1 Oct. 23, 2014

(30) Foreign Application Priority Data

Nov. 10, 2011 (GB) ..... 1119393.5
Aug. 14, 2012 (GB) ..... 1214486.1

(51) Int. Cl.
*E01F 15/00* (2006.01)
*E01F 13/04* (2006.01)

(52) U.S. Cl.
CPC ..... *E01F 13/048* (2013.01)

(58) Field of Classification Search
CPC ..... E01F 13/048
USPC ..... 404/6; 49/49
See application file for complete search history.

(56) References Cited

U.S. PATENT DOCUMENTS 4,472,908 A * 9/1984 Wanzl et al. ..... 49/25
4,554,695 A * 11/1985 Rowland ..... 14/69.5

(Continued)

FOREIGN PATENT DOCUMENTS

AU 2004201403 10/2004
FR 2930789 11/2009

OTHER PUBLICATIONS

International Search Report cited in PCT/GB2012/000821, mailed Feb. 12, 2013.

(Continued)

*Primary Examiner* — Thomas B Will
*Assistant Examiner* — Katherine Chu
(74) *Attorney, Agent, or Firm* — Lempia Summerfield Katz LLC

(57) ABSTRACT

The invention relates to a security barrier apparatus (10, 70, 100) comprising a support (12) having at least three upright posts (14, 16, 18, 72) thereon. Two of the posts (14, 18) being fixed to the support (12) and at least one post (16, 72) being translatably movable relative to the two fixed posts (14, 18). The two fixed posts (14, 18) being spaced apart from one another and comprise a first plane (19) therebetween. The movable post (16, 72) being mounted to a slide device (24) of the support (12) for providing said translatable movement. The slide device (24) to operate the apparatus (10, 70) between an open position and a closed position such that in the closed position the movable post (16, 72) is between the fixed posts (14, 18) for inhibiting the passage of a vehicle, and in the open position the movable post (16, 72) is out of alignment with the first plane (19) and adjacent to one of the fixed posts (14, 18) for allowing the passage of a vehicle therebetween.

19 Claims, 8 Drawing Sheets

(56) References Cited

U.S. PATENT DOCUMENTS

| | | | | |
|---|---|---|---|---|
| 4,715,742 | A * | 12/1987 | Dickinson | 404/6 |
| 5,054,237 | A * | 10/1991 | Kapala et al. | 49/35 |
| 2008/0038055 | A1 * | 2/2008 | Jankovsky | 404/6 |
| 2011/0271593 | A1 * | 11/2011 | Hayashida et al. | 49/49 |

OTHER PUBLICATIONS

Great Britain Search Report cited in GB1119393.5, mailed Feb. 29, 2012.

Great Britain Search Report cited in GB1214486.1, mailed Feb. 19, 2013.

* cited by examiner

SECURITY BARRIER APPARATUS

RELATED APPLICATION DATA

This U.S. national phase application is based on and claims priority benefit of international application Serial No. PCT/GB2012/000821 filed on Oct. 31, 2012, which claimed priority to Great Britain national application No. 1119393.5 filed on Nov. 10, 2011 and Great Britain national application No. 1214486.1 filed Aug. 14, 2012. Priority benefit of each of these earlier filed applications is hereby claimed, and the full disclosures of each of these earlier filed applications are hereby incorporated by reference herein.

TECHNICAL FIELD

The invention relates to a security barrier apparatus, and a method for operation thereof.

BACKGROUND

A security barrier or bollard may be used for resisting an unauthorised passage of a vehicle such as a car or a lorry. Such barriers typically comprise a support with a barrier member or post mounted to it. The support may be cast into concrete foundations below ground level, or it may be surface mounted above the ground level. The barrier member or post is typically arranged to be retractable so that it can be stowed relative to the support to allow the vehicle to pass, or deployed to a working position to prevent or inhibit the vehicle to pass.

In different countries the security barrier or bollard may be required to comply with various parameters. Such parameters may relate to various dimensions for the security barrier or bollard. One such parameter may be that a maximum gap between bollards may not be more than 1.2 m. Defining such a maximum gap may provide an assurance that a vehicle wider than 1.2 m cannot simply drive between the bollards. Another parameter may be that a minimum gap between movable parts of the security barrier or bollard is not less than 0.4 m, which may be particularly relevant in the case of powered movable parts of the security barrier or bollard. Defining such a minimum gap may provide the advantage of reducing the possibility for people or objects to become trapped by the movable parts, which may provide an assurance that the security barrier or bollard is effective and safe to operate.

Security barriers or bollards are typically provided in two categories. The first category is a high security barrier, or anti-terrorist barrier, that is intended to prevent a vehicle from passing. Such a barrier is robustly constructed and is typically about 1-1.5 meters above ground level. A high security barrier might be used at a road entrance to an airport or an official building, such as a Government building, and is typically able to withstand a crash impact from a car or lorry. The second category of security barrier might be used at a home or work premises to safeguard a car parking space or driveway from being used by an unauthorised vehicle. Such barriers are relatively less robustly constructed, and may extend up to one meter above ground level.

It is known to provide a security bollard or post which is pivotable on a support between a vertical position and a horizontal position. The support may be surface mounted on the ground, or it may be cast into a concrete foundation within the ground. Such arrangements have the disadvantage that the security bollard or post may form a trap hazard with the ground as it moves to the stowed position, which may represent a safety risk.

It is also known to provide a security bollard or post which is movable relative to a housing between a vertical position above ground and a vertical position below ground. Such arrangements have the problem of requiring a deep foundation for the housing for the post, which must be at least as deep as the height of the bollard above ground. Using such a deep foundation is disadvantageous, particularly in an urban environment, because it may interfere with services such as power lines, drains, or communication cables. In an alternative arrangement the post is telescopic so that the foundations for the housing are not required to be as deep. Such security bollards or posts generally represent less of a safety hazard than the pivotable security bollard or post because there is no trap hazard, but they may be more costly and complex.

It is broadly an object of the present invention to address one or more of the above mentioned disadvantages of previously known security barriers.

SUMMARY

What is required is a security barrier apparatus that can be deployed and retracted, which may reduce or minimise at least some of the above-mentioned problems.

According to a first aspect of the invention, there is provided a security barrier apparatus, comprising a support having at least three upright posts thereon, two of the posts being fixed to the support and at least one post being translatably movable relative to the two fixed posts, the two fixed posts being spaced apart from one another and comprise a first plane therebetween, the movable post being mounted to a slide device of the support for providing said translatable movement, the slide device to operate the apparatus between an open position and a closed position such that in the closed position the movable post is between the fixed posts for inhibiting the passage of a vehicle, and in the open position the movable post is out of alignment with the first plane and adjacent to one of the fixed posts for allowing the passage of a vehicle therebetween.

Such a security barrier apparatus provides the advantage that there is a reduced risk of trapping an item or a person between the posts because in the open position of the apparatus the movable post is out of alignment with the first plane and adjacent to one of the fixed posts. Furthermore, the apparatus may be mounted on a driving surface such as a road or a driveway without the requirement for a foundation in the ground, which may be advantageous to avoid interfering with services such as power lines, drains, or communication cables in the ground. In addition, such a security barrier apparatus may be required to comply with various parameters, and in particular, a minimum distance requirement between the movable post and one of the fixed posts. This may provide the advantage of reducing the risk of people or objects becoming trapped between them. Such a security barrier apparatus may be configured to substantially prevent a vehicle from passing or to safeguard a car parking space or driveway from being used by an unauthorised vehicle.

Preferably in the closed position of the apparatus the movable post is substantially aligned with the fixed posts within the first plane. Such an arrangement provides an advantageous configuration of the security barrier apparatus in the closed position.

Preferably the movable post and said one of the fixed posts comprise a second plane therebetween, wherein in the open position of the apparatus an angle between the first plane and the second plane is greater than or equal to 90°. Such an arrangement provides the advantage that the movable post may not interfere with a vehicle as it passes between the two fixed posts.

Preferably the movable post is spaced apart from said one of the fixed posts in the open position of the apparatus. In one embodiment the movable post is at a distance of greater than 0.4 m from said one of the fixed posts in the open position of the apparatus. In a preferred embodiment the movable post is at a distance of substantially 0.6 m from said one of the fixed posts in the open position of the apparatus. Such an arrangement may further reduce the risk of an item or a person becoming trapped between one of the fixed posts and the movable post. Such an arrangement may further permit the security barrier apparatus to comply with various parameters, and in particular the minimum distance requirement between the movable post and said one of the fixed posts.

Preferably the translatable movement of the movable post is provided in substantially a straight line. Preferably the movable post is at a distance of greater than 0.4 m from said one of the fixed posts as the apparatus is operated between the open and the closed positions. Such arrangements provide an advantageous configuration of the security barrier apparatus, and may further permit the security barrier apparatus to comply with various parameters, and in particular the minimum distance requirement.

Preferably the support has an upper surface for a vehicle. The upper surface is an uppermost part of the support on which a vehicle can drive or a person can walk.

Preferably the upper surface has an elongate aperture in which the movable post is translatably movable between the open and the closed positions. Preferably the movable post is close fitting within the elongate aperture. Preferably an inner edge of the elongate aperture is chamfered. Such arrangements may reduce the risk that items become trapped between the movable post and the inner edge of the elongate aperture.

Preferably a front edge of the support is provided with a first ramp. Preferably a rear edge of the support is provided with a second ramp. Such ramps provide the advantage of assisting a vehicle to drive onto the upper surface.

In one embodiment the slide device comprises a belt or track to operate the movable post, the belt or track being arranged to move in a horizontal plane to operate the apparatus between the open and the closed positions. Preferably the belt or track is arranged to close the elongate aperture as the apparatus is operated between the open and closed positions. Using such a belt provides the combined advantages of being a convenient arrangement for operating the movable post whist keeping the elongate aperture closed to inhibit debris from entering it. Furthermore, keeping the elongate aperture closed inhibits feet or hands from becoming trapped between the movable post and the elongate aperture.

In another embodiment the slide device comprises a platform upon which the movable post is mounted, the platform being movable relative to the support. Preferably the platform is movable on at least one rail of the support. Such an arrangement may provide a convenient way of providing the translatable movement.

Preferably the platform and the support have respective engagement portions thereon for engaging one another and for inhibiting movement of the movable post relative to the support in the event of an impact force being exerted on the movable post. Such an arrangement inhibits the movable post from moving in the event of an impact from a vehicle, and provides an improved strength to the security barrier apparatus.

Preferably the platform has a plurality of belt or track members attached thereto. The plurality of belt members may be attached to the platform with a chain. Preferably the plurality of belt or track members are arranged to close the elongate aperture as the apparatus is operated between the open and closed positions. Using such an arrangement has the advantage of keeping the elongate aperture closed to inhibit debris from entering it. Furthermore, keeping the elongate aperture closed inhibits feet or hands from becoming trapped between the movable post and the elongate aperture.

Preferably the plurality of track members have respective front and rear edges which abut adjacent track members, the front and rear edges being curved so that they cooperate with the adjacent track members.

Preferably the plurality of track members each have at least one wheel on an under part thereof. Preferably at least one of the plurality of track members has at least one side wheel for engaging the at least on rail of the support.

In one embodiment the security barrier apparatus includes a drive device to provide said translatable movement of the movable post relative to the fixed posts. The drive device may comprise at least one actuator or motor. Preferably the at least one actuator is operable to move the slide device such that a movement of a ram of the actuator provides an amplified movement of the slide device.

In an alternative embodiment the movable post is manually operable between the open and the closed positions.

Preferably the security barrier apparatus further includes a lock device to lock the apparatus in the closed position. Such an arrangement may further inhibit a vehicle from passing.

In one embodiment the security barrier apparatus includes two movable posts being translatably movable relative to the two fixed posts, each movable post being mounted to a respective slide device of the support for providing said translatable movement, the slide devices to operate the apparatus between the open position and the closed position such that in the closed position the two movable posts are between the fixed posts for inhibiting the passage of a vehicle, and in the open position the movable posts are out of alignment with the first plane and adjacent to a respective fixed post for allowing the passage of a vehicle therebetween. Such an arrangement provides the advantage of allowing a wider vehicle to pass between the fixed posts whilst also allowing the apparatus to comply with various parameters.

According to a second aspect of the invention there is provided a method of operating a security barrier apparatus comprising a support having at least three upright posts thereon, two of the posts being fixed to the support and at least one post being translatably movable relative to the two fixed posts, the two fixed posts being spaced apart from one another and comprise a first plane therebetween, the method including:

operating the apparatus between a closed position where the at least one movable post is between the two fixed posts for inhibiting the passage of a vehicle, and an open position where the at least one movable post is out of alignment with the first plane and adjacent to one of the fixed posts for allowing passage of a vehicle therebetween.

Such a method provides the advantage that there is a reduced risk of trapping an item or a person between the posts because in the open position of the apparatus the movable post is out of alignment with the first plane and adjacent to one of the fixed posts. In addition, such a method of operating the security barrier apparatus may allow the apparatus to comply with various parameters, and in particular, a minimum distance requirement between the movable post and one of the fixed posts. This may provide the advantage of reducing the risk of people or objects becoming trapped between them.

The method of operating security barrier apparatus may be used to substantially prevent a vehicle from passing or to safeguard a car parking space or driveway from being used by an unauthorised vehicle.

Preferably the method further includes operating the apparatus so that the movable post is substantially aligned with the fixed posts within the first plane in the closed position of the apparatus. Such a method provides an advantageous configuration for the security barrier apparatus.

Preferably the movable post and said one of the fixed posts comprise a second plane therebetween, the method including operating the apparatus so that an angle between the first plane and the second plane is greater than or equal to 90° in the open position. Such a method provides the advantage that the movable post may not interfere with a vehicle as it passes between the two fixed posts.

Preferably the method further includes operating the apparatus so that the movable post is spaced apart from said one of the fixed posts in the open position. Such a method may further reduce the risk of trapping an item or a person between one of the fixed posts and the movable post. Such a method may further comply with various parameters.

Preferably the method further includes operating the movable post in substantially a straight line between the open and the closed positions. Preferably the method further includes operating the movable post between the open and the closed positions so that it is at a distance of greater than 0.4 m from said one of the fixed posts. Such a method provides an advantageous way of operating the security barrier apparatus, and may further permit the security barrier apparatus to comply with various parameters, and in particular the minimum distance requirement.

Preferably the support has an upper surface for a vehicle, and the upper surface has an elongate aperture in which the movable post is translatably movable between the open and the closed positions, the method including closing the elongate aperture as the apparatus is operated between the open and the closed positions. The upper surface is an uppermost part of the support on which a vehicle can drive or a person can walk. Such a method may reduce the risk that items become trapped between the movable post and the elongate aperture, and may inhibit debris from entering the elongate aperture.

Preferably the method further includes locking the apparatus in the closed position. Such a method may further inhibit a vehicle from passing.

In one embodiment the security barrier apparatus further includes two movable posts which are translatably movable relative to the two fixed posts, the method including operating the apparatus between a closed position where the two movable posts are between the two fixed posts for inhibiting the passage of a vehicle, and an open position where the two movable posts are out of alignment with the first plane and adjacent to a respective fixed post for allowing passage of a vehicle therebetween. Such a method provides the advantage of allowing a wider vehicle to pass between the fixed posts and may further permit the security barrier apparatus to comply with the various parameters.

According to an alternative characterisation of the invention there is provided a security barrier apparatus, comprising a support with a first upright post and a second upright post fixed thereon, and at least one additional upright post which is translatably movable thereon relative to the first and second posts, the first and second upright posts being spaced apart from each other, the additional upright post being movable between a stowed position for allowing passage of a vehicle between the first and the second upright posts and a deployed position for inhibiting passage of a vehicle, wherein in the deployed position the at least one additional upright post is substantially aligned with and between the first and second upright posts, and in the stowed position the at least one additional upright post is out of alignment with the first and second upright posts.

According to another alternative characterisation of the invention there is provided a security barrier apparatus, comprising a support with an upper surface having at least three upright posts thereon, the apparatus being operable between an open position for allowing passage of a vehicle and a closed position for inhibiting passage of a vehicle, in the closed position the posts being spaced apart and substantially aligned with each other in a first plane such that there are two outer posts and at least one inner post, the outer posts being fixed to the support, wherein the inner post is mounted to a slide device of the support for providing a translatable movement of the inner post relative to the outer posts, the slide device to operate the apparatus between the open position and the closed position such that in the open position the at least one inner post is out of alignment with the first plane and adjacent to one of the outer posts for allowing said passage of a vehicle between the outer posts and on the upper surface.

Any preferred or optional features of one aspect or characterisation of the invention may be preferred or optional feature of other aspects or characterisations of the invention.

BRIEF DESCRIPTION OF THE DRAWINGS

Other features of the invention will be apparent from the following description of preferred embodiments shown by way of example only with reference to the accompanying drawings, in which.

DETAILED DESCRIPTION

Figure 1:
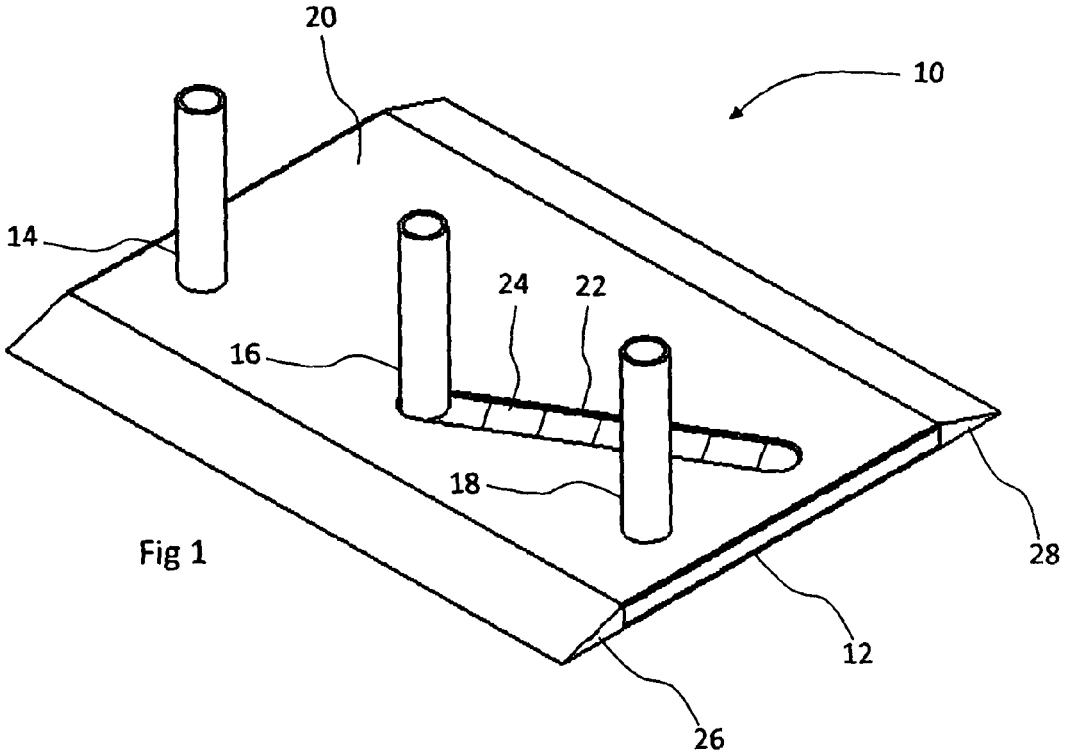
FIG. 1 shows a perspective view of a security bather apparatus in a closed position according to an embodiment of the invention.

FIG. 1 shows a perspective view of a security bather apparatus in a closed position according to an embodiment of the invention, generally designated 10. The apparatus 10 comprises a base 12, also known as a support, with three upright posts 14, 16, 18 thereon. The posts 14, 16, 18 are, for example, steel tubes which are about 1 m above the ground and about 0.22 m in diameter. Alternatively the posts 14, 16, 18 may be termed barrier members. The three posts 14, 16, 18 are spaced apart on the base 12 and are aligned with each other to form a straight line of posts 14, 16, 18 in the closed position of the security barrier apparatus 10. The outer posts 14, 18 define a first plane 19 (shown in FIGS. 3, 4, and 12) between them, and in the closed position of the apparatus 10 the posts 14, 16, 18 are in the first plane 19. The two outer posts 14, 18 are fixed to the base 12 so that they do not move. Alternatively the two outer posts 14, 18 may be termed fixed posts. The inner post 16 is movably attached to the base 12 so that it is translatable relative to the outer posts 14, 18 and remains substantially upright during movement. The inner post 16 may alternatively be termed a movable post. In the closed position of the security barrier apparatus 10 the inner post 16 is between the two outer posts 14, 18, and substantially mid-way between the two outer posts 14, 18.

An upper surface 20 of the base 12 has an elongate aperture 22 in which the inner post 16 is movable. The inner post 16 is mounted to a belt 24 which is arranged to be horizontally movable within the base 12 in a direction along the length of the elongate aperture 22. The belt 24 provides the advantage of closing the elongate aperture 22 as the apparatus 10 is operated between the open and closed positions. This may improve the safety of operation of the apparatus 10, and may inhibit debris from entering the elongate aperture 22.

The elongate aperture 22 is substantially straight. The inner post 16 is close fitting with the elongate aperture 22. The inner edge of the elongate aperture 22 is chamfered. The close fitting inner post 16 within the elongate aperture 22, and the chamfered inner edge of the elongate aperture may reduce the risk that items become trapped between the inner post 16 and the inner edge of the elongate aperture 22. Furthermore the chamfered edge may reduce or avoid a potential trip hazard. The upper surface 20 may be a plate which is about 15 mm thick. Accordingly, the belt 24 is about 15 mm below the upper surface 20.

The base 12 comprises a generally flat box which is about 3.5 m in length and about 2 m in width. Accordingly the apparatus 10 has a relatively small footprint. The base 12 is for securing on top of a ground surface 52 (shown in FIG. 5) such as a driving surface for a vehicle which may be a road or a driveway. The base 12 is about 0.13 m in height above the ground surface, and as such it is relatively shallow. The base 12 has ramps 26, 28 along each of the front and rear edges thereof to assist a vehicle with driving onto the base 12 and onto the upper surface 20.

Figure 2:
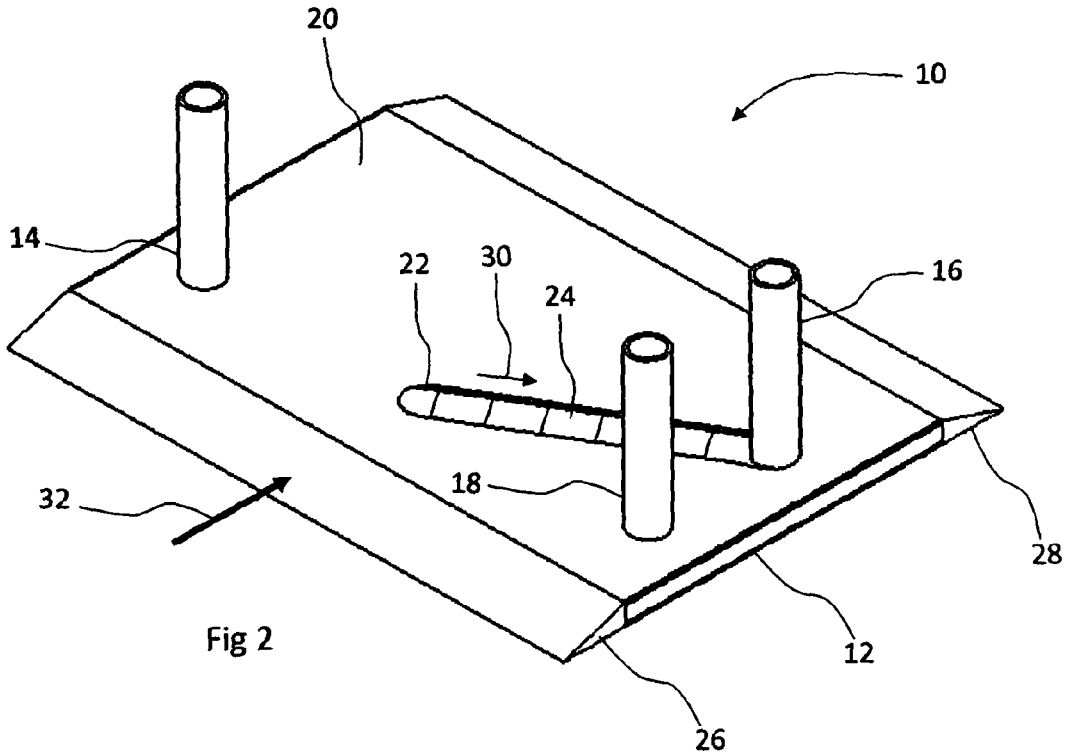
FIG. 2 shows a perspective view of the security barrier apparatus shown in FIG. 1 in an open position.

FIG. 2 shows a perspective view of the security barrier apparatus 10 shown in FIG. 1 in an open position. In FIG. 2 like features to the arrangements of FIG. 1 are shown with like reference numerals. In FIG. 2 the inner post 16 is shown to be moved to the open position of the apparatus 10 so that it is out of the plane 19 containing the two outer posts 14, 18. The inner post 16 is behind the outer post 18 so that it is adjacent to it and spaced apart from it. An arrow 30 indicates the direction of movement of the inner post 16. The inner post 16 is movable to the open position of the apparatus 10 by the belt 24.

It will be appreciated that the posts 14, 16, 18 remain substantially upright between the open and the closed positions of the apparatus 10 so that they remain substantially parallel to one another. In the open position of the apparatus 10 a vehicle (not shown) can pass between the outer posts 14, 18, as indicated by an arrow 32, so that it drives over the upper surface 20. Since the inner post 16 is behind the outer post 18 it does not interfere with the passage of the vehicle. Accordingly a maximum gap 58 (shown in FIG. 5) between each of the posts 14, 16, 18 can be controlled by setting the distance between the outer posts 14, 18 and locating the inner post 16 midway between them in the closed position of the apparatus. The inner post 16 and the outer post 18 define a second plane 44 (shown in FIGS. 4, 7 and 12) therebetween, and in the open position of the apparatus 10 an angle 46 (shown in FIG. 4) between the first plane 19 and the second plane 44 is about 90°. It will be appreciated that the angle 46 may be greater than 90° without interfering with a vehicle passing between the outer posts 14, 18 in the direction indicate by the arrow 32. If the angle 46 is greater than 90° it should not be so large that the length of the base 12 is also required to be too large. It is envisaged that the angle 46 may be up to 120°.

The apparatus 10 may be placed on a road or driveway so that the outer posts 14, 18 are adjacent to a respective wall on either side of the apparatus 10 in order to safeguard an entrance to the road or driveway. The walls may alternatively be fences, concrete blocks or other barriers to inhibit the vehicle from passing between the walls and one of the outer posts 14, 18.

Figure 3:
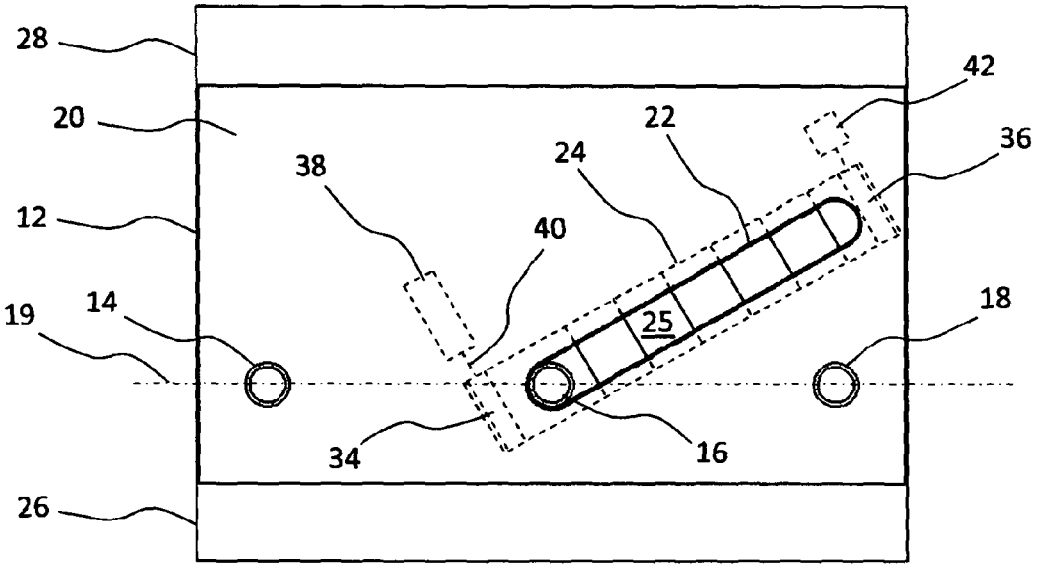
FIG. 3 is a plan view of the arrangement of FIG. 1.

FIG. 3 is a plan view of the arrangement of FIG. 1, and shows the apparatus 10 in the closed position. In FIG. 3 like features to the arrangements of FIGS. 1 and 2 are shown with like reference numerals. In FIG. 3 the three posts 14, 16, 18 are shown to be in the first plane 19, which is represented by a line. Also shown is further detail of the belt 24 which is a slide device to provide the translatable movement of the inner post 16. The belt 24 is continuous and mounted on rollers 34, 36 at either end of the elongate aperture 22 so that the inner post 16 can be moved between the open and the closed positions of the apparatus 10. The belt 24 may be made of a plurality of belt members 25 which are pivotably connected to each another.

In one arrangement the inner post 16 is movable by hand between the open and the closed positions, for example by a user pushing the inner post 16 to the open or the closed positions of the apparatus 10. In another arrangement a drive device is provided to move the inner post 16 between the open and the closed positions. The drive device comprises a motor 38 which is coupled to the roller 34 by a drive shaft 40 or a chain drive (not shown). An appropriate power source (not shown) is provided to operate the motor 38. Other arrangements are envisaged for operating the belt 24 to move the inner post 16 between the closed and the open positions such as a hydraulic actuator. It is envisaged that a control panel may be provided to operate the motor 38 or the hydraulic actuator. In another arrangement the drive device comprises a battery powered drill which the user may couple to a gearbox 42 of the base 12, which is coupled to the roller 36. Using the battery powered drill provides the advantage that a separate power supply, such as an electric cable connected to a mains power supply, is not required to operate the drive device. This may further improve the portability of the apparatus 10. It will be appreciated that the base 12 has a hollow portion for housing the belt 24, the rollers 34, 36, the motor 38, and the gearbox 42. These items are shown in dashed outline in FIGS. 3 and 4 because they are under the upper surface 20.

Figure 4:
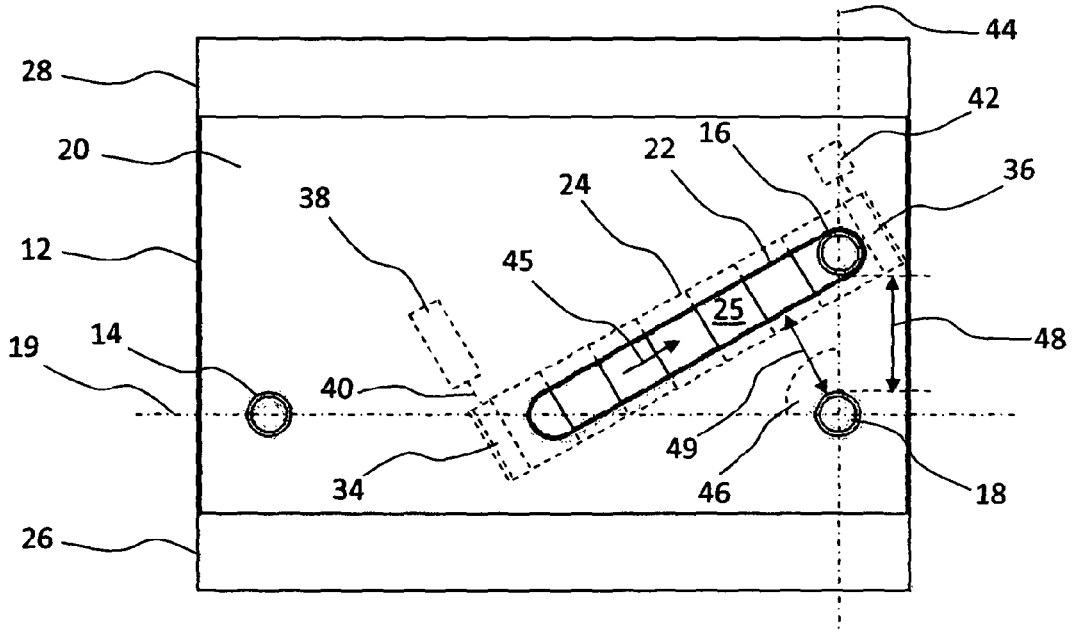
FIG. 4 is a plan view of the arrangement of FIG. 2.

FIG. 4 is a plan view of the arrangement of FIG. 2, and shows the apparatus 10 in the open position. In FIG. 4 like features to the arrangements of FIGS. 1-3 are shown with like reference numerals. In FIG. 4 the inner post 16 is shown to be moved out of the first plane 19 so that it is behind the outer post 18 and adjacent to it. An arrow 45 indicates the direction of movement of the inner post 16. The inner post 16 and the outer post 18 define the second plane 44 therebetween, which is represented by a line. In the open position of the apparatus 10 the angle 46 between the first plane 19 and the second plane 44 is greater than or equal to 90°. With such an arrangement the inner post 16 does not interfere with the passage of the vehicle between the outer posts 14, 18. In the open position the inner post 16 and the outer post 18 are spaced apart from one another, for example by a distance of not less than 0.6 m as shown by an arrow 48. Furthermore, a minimum distance between the inner post 16 and the outer post 18 as the apparatus is operated between the open and the closed positions is not less than 0.4 m as shown by an arrow 49.

Figure 5:
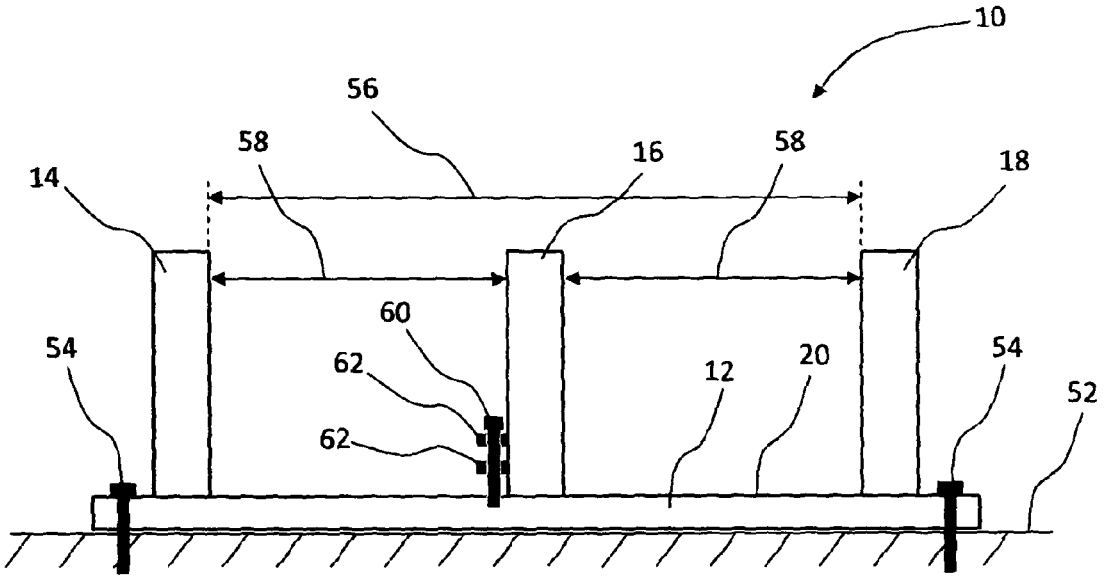
FIG. 5 is a front view of the arrangement shown in FIGS. 1 and 3.

FIG. 5 is a front view of the arrangement shown in FIGS. 1 and 3, and shows the apparatus 10 in the closed position. In FIG. 5 like features to the arrangements of FIGS. 1-4 are shown with like reference numerals. In FIG. 5 the apparatus 10 is shown to be secured to a ground surface 52, for example using fasteners 54 which may be expandable bolts arranged to pass through the base 12 and below the ground surface 52. In such a manner the base 12 is provided with at least one ground anchor.

The maximum gap 58 between the posts 14, 16 and 16, 18 is set so that it is not more than 1.2 m. Accordingly a maximum gap 56 between the outer posts 14, 18 is typically not more than 2.6 m, which takes into account the diameter of the inner post 16. A lock device is also shown in FIG. 5 to lock the apparatus 10 in the closed position. The lock device is, for example, a movable bolt 60 which is mounted to the inner post 16 on supports 62. The movable bolt 60 is slidable on the supports 62 so that it can be moved up or down to engage the base 12 to lock the inner post 16 in the closed position. Such a lock device may further inhibit a vehicle from passing.

Figure 6:
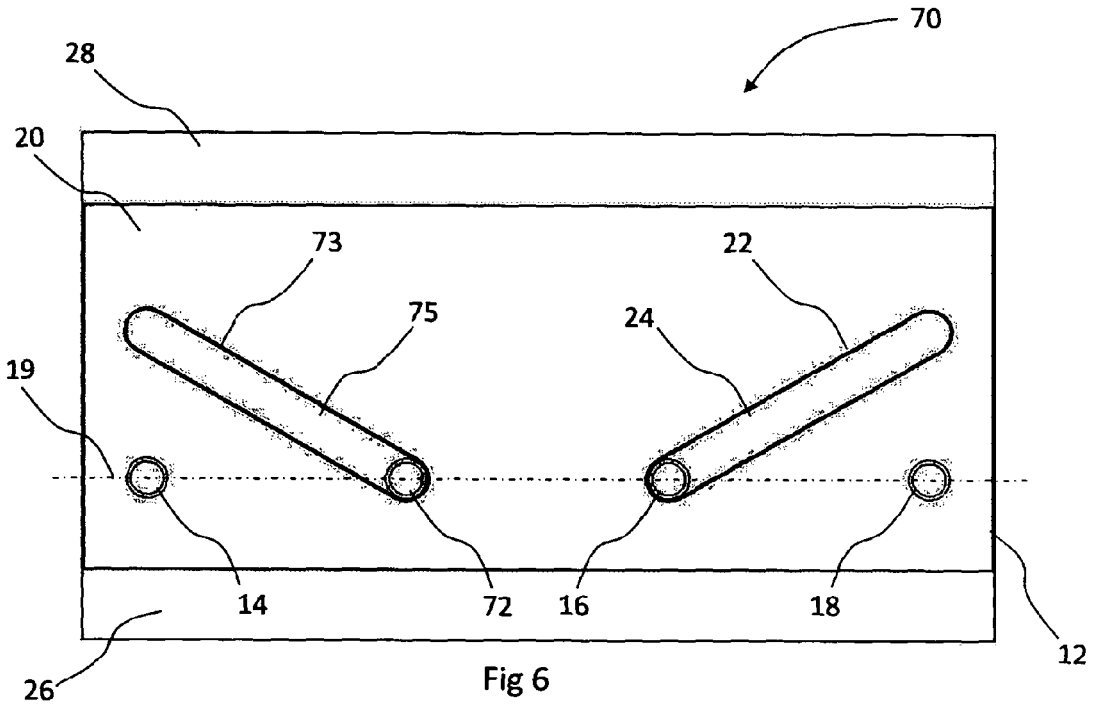
FIG. 6 shows a plan view of a security barrier apparatus in a closed position according to another embodiment of the invention.

FIG. 6 shows a plan view of a security barrier apparatus in a closed position according to another embodiment of the invention, generally designated 70. In FIG. 6 like features to the arrangements of FIGS. 1-5 are shown with like reference numerals. In FIG. 6 an additional inner post 72 is provided so that there are four posts 14, 16, 18, 72. The four posts 14, 16, 18 are spaced apart on the base 12 and are aligned with each other to form a straight line of posts 14, 16, 18, 72 in the closed position of the security barrier apparatus 70. The outer posts 14, 18 define the first plane 19 between them, and in the closed position the posts 14, 16, 18, 72 are in the first plane 19. The two outer posts 14, 18 are fixed to the base 12 so that they do not move. The inner posts 16, 72 are movably attached to the base 12 so that they are translatable relative to the outer posts 14, 18 and remains substantially upright during movement. In the closed position of the security barrier apparatus 10 the inner posts 16, 72 are evenly spaced between the two outer posts 14, 18. The upper surface 20 of the base 12 has a second elongate aperture 73 in which the additional inner post 72 is movable. The additional inner post 72 is mounted to a second belt 75 which is arranged to be horizontally movable within the base 12 in a direction along the length of the second elongate aperture 73. The second belt 75 also closes the second elongate aperture 73 as the apparatus 70 is operated between the open and closed positions. The second elongate aperture 73 is substantially straight. The additional inner post 72 is close fitting with the second elongate aperture 73.

Figure 7:
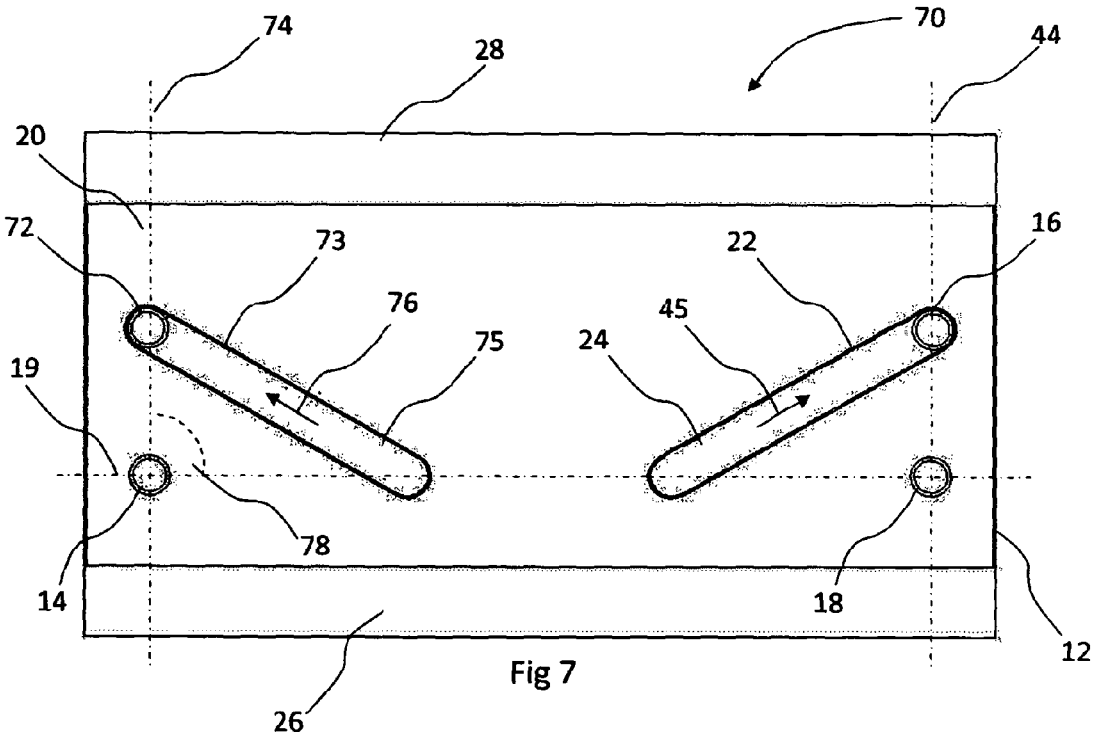
FIG. 7 shows a plan view of the security barrier apparatus shown in FIG. 6 in an open position.

FIG. 7 shows a plan view of the security barrier apparatus 70 shown in FIG. 6 in an open position. In FIG. 7 like features to the arrangements of FIGS. 1-6 are shown with like reference numerals. In FIG. 7 the additional inner post 72 is shown to be moved to the open position of the apparatus 70 so that it is out of the plane 19 containing the two outer posts 14, 18. The inner post 72 is behind the outer post 14 so that it is adjacent to it and spaced apart from it. An arrow 76 indicates the direction of movement of the additional inner post 72. The additional inner post 72 is movable to the open position of the apparatus 70 by the second belt 75.

It will be appreciated that the posts 14, 16, 18, 72 remain substantially upright between the open and the closed positions of the apparatus 70 so that they remain substantially parallel to one another. In the open position of the apparatus 70 a vehicle (not shown) can pass between the outer posts 14, 18, so that it drives over the upper surface 20. Since the additional inner post 72 is behind the outer post 14, and the inner post 16 is behind the outer post 18, they do not interfere with the passage of the vehicle. Accordingly a maximum gap between each of the posts 14, 16, 18, 72 can be controlled by setting the distance between the outer posts 14, 18. The additional inner post 72 and the outer post 14 define a third plane 74 therebetween, and in the open position of the apparatus 70 an angle 78 between the first plane 19 and the third plane 74 is about 90°. It will be appreciated that the angle 78 may be greater than 90° without interfering with a vehicle passing between the outer posts 14, 18. The arrangements for moving the additional inner post 72 and the inner post 16 are similar. If the angle 78 is greater than 90° it should not be so large that the length of the base 12 is also required to be too large. It is envisaged that the angle 78 may be up to 120°.

The arrangements of FIGS. 6 and 7 mean that two inner posts 16, 72 are provided which are movable out of the first plane 19 and into their respective planes 44, 74. Such an arrangement may provide for the maximum gap 56 between the outer posts 14, 18 to be typically not more than 4 m, which may be a useful configuration of the apparatus 70 to permit wider vehicles to pass between the fixed posts 14, 18.

Figure 8:
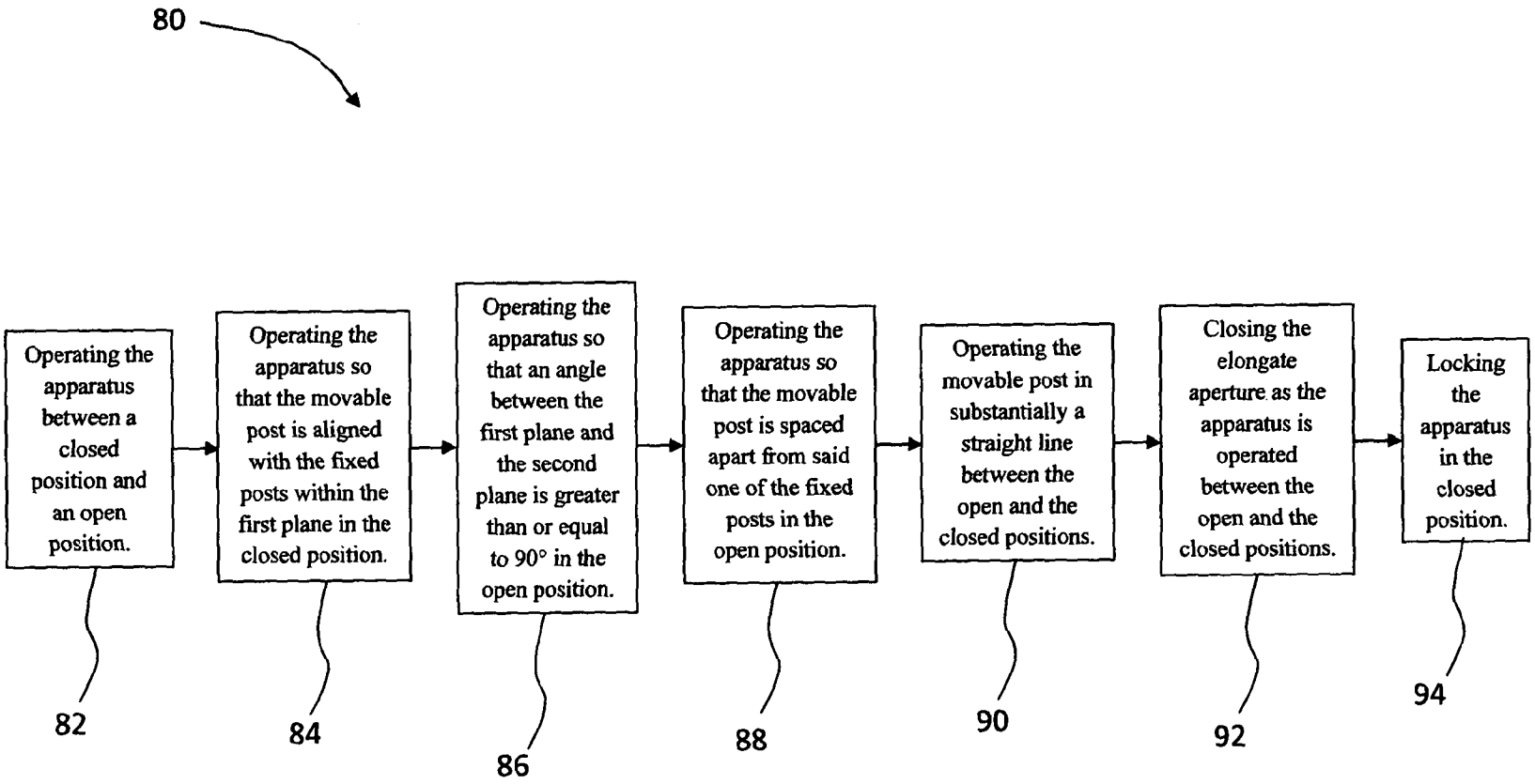
FIG. 8 is a diagram of a method according to an embodiment of the invention.

FIG. 8 is a diagram of a method according to an embodiment of the invention, generally designated 80. The method 80 is a method of operating a security barrier apparatus 10, 70 comprising a support 12 having at least three upright posts 14, 16, 18, 72 thereon, two of the posts 14, 18 being fixed to the support 12 and at least one post 16, 72 being translatably movable relative to the two fixed posts 14, 18, the two fixed posts 14, 18 being spaced apart from one another and comprise a first plane therebetween 19. The method 80 includes operating the apparatus between a closed position where the at least one movable post 16, 72 is between the two fixed posts 14, 18 for inhibiting the passage of a vehicle, and an open position where the at least one movable post 16, 72 is out of alignment with the first plane 19 and adjacent to one of the fixed posts 14, 18 for allowing passage of a vehicle between the fixed posts 14, 18, as shown at 82.

The method 80 further includes operating the apparatus 10, 70 so that the movable post 16, 72 is substantially aligned with the fixed posts 14, 18 within the first plane 19 in the closed position of the apparatus 10, 70, as shown at 84. The movable post 16, 72 and said one of the fixed posts 14, 18 comprising a second plane 44, 74 therebetween, the method 80 includes operating the apparatus 10, 70 so that an angle 46, 78 between the first plane 19 and the second plane 44, 74 is greater than or equal to 90° in the open position, as shown at 86. The method 80 further includes operating the apparatus 10, 70 so that the movable post 16, 72 is spaced apart from said one of the fixed posts 14, 18 in the open position, as shown at 88. The method 80 further includes operating the movable post 16, 72 in substantially a straight line between the open and the closed positions, as shown at 90. The method may further include operating the movable post 16, 72 between the open and the closed positions so that it is at a distance of greater than 0.4 m from said one of the fixed posts 14, 18. The support 12 has an upper surface 20 for a vehicle, and the upper surface 20 has an elongate aperture 22 in which the movable post 16, 72 is translatably movable between the open and the closed positions.

The method 80 includes closing the elongate aperture 22 as the apparatus 10, 70 is operated between the open and the closed positions, as shown at 92. The method 80 further includes locking the apparatus 10, 70 in the closed position, as shown at 94.

Figure 9:
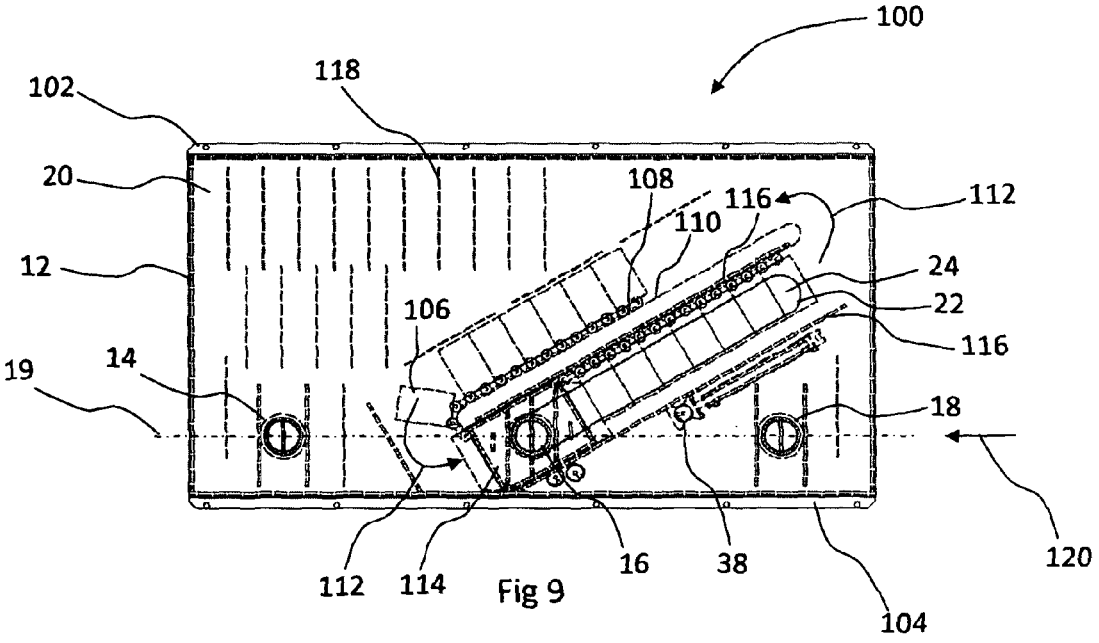
FIG. 9 shows a plan view of a security barrier apparatus in a closed position according to another embodiment of the invention.
Figure 10:
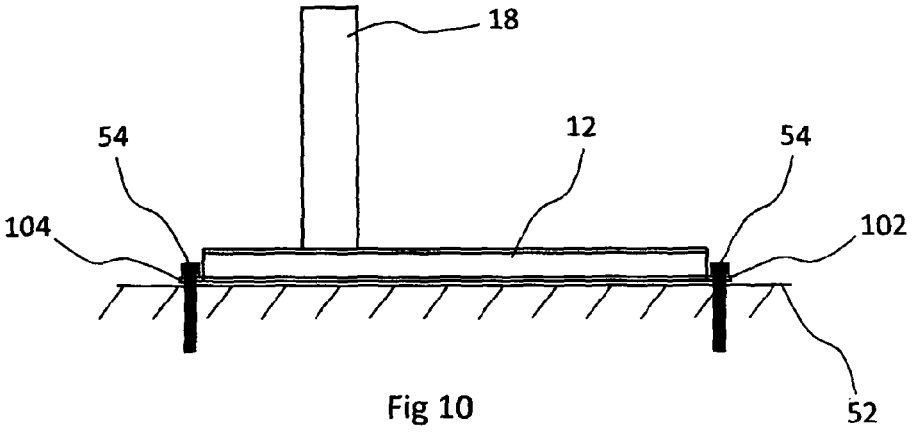
FIG. 10 shows a side view of the arrangement of FIG. 9.

FIG. 9 shows a plan view of a security barrier apparatus in a closed position, generally designated 100 according to another embodiment of the invention. In FIG. 9 like features to the arrangements of FIGS. 1-7 are shown with like reference numerals. In FIG. 9 the hidden details below the top surface 20 are shown. The base 12 is shown to have lips 102, 104 along each of the front and rear edges thereof. Each lip 102, 104 has holes spaced along them to receive fasteners 54 to secure the apparatus 100 to the ground as shown in FIG. 10.

FIG. 9 shows an alternative arrangement for the slide device to provide the translatable movement of the inner post 16, 72. The slide device comprises a plurality of substantially horizontal portions 106, which may alternatively be termed belt members, which are mounted to a chain 108. The chain 108 is movable on a track 110 shown with a dashed line. The portions 106 are plates which abut or overlap each other so that the aperture 22 remains substantially closed as the inner post 16 is moved between the open and the closed positions. The chain 108 comprises a plurality of links which are pivotably connected to one another. The track 110 is fixed to the base 12 and comprises a loop so that the chain 108 is moveable thereon. The loop comprises two substantially straight sides which are closed by curved ends. Such an arrangement allows the portions 106 to move along the straight sides and to curve around the ends of the loop as shown by the arrows 112. Also shown is a plate 114 upon which the inner post 16 is mounted.

The plate 114 may alternatively be termed a platform or a carriage. The plate 114 is rectangular and is linearly moveable on substantially parallel rails 116 so that the inner post 16 is movable in the aperture 22. The parallel rails 116 are fixed to the base 12. The chain 108 is attached to the plate 114 so that as the inner post 16 is moved within the aperture 22 the chain 108 moves the portions 106 to close the aperture. A plurality of reinforcing plates 118 are provided between the upper and lower parts of the base 12. The reinforcing plates 118 are substantially vertical and operate to strengthen the base 12 to resist deforming thereof when a vehicle drives on the upper surface 20.

FIG. 9 also shows a drive device to move the inner post 16 between the open and the closed positions. The drive device comprises a cable (not shown) which is operable to move the plate 114. The cable is mounted on one or more pulleys and is attached to the plate 114. The cable is operated by the motor 38. An appropriate power source (not shown) is provided to operate the motor 38. Other arrangements are envisaged for moving the plate 114 such as a hydraulic actuator.

FIG. 10 shows a side view of the arrangement of FIG. 9 from the direction of arrow 120 in FIG. 9. In FIG. 9 like features to the arrangements of FIG. 10 are shown with like reference numerals. In FIG. 10 the fasteners 54 are shown to pass through the lips 102, 104 to secure the base to the ground.

Figure 11:
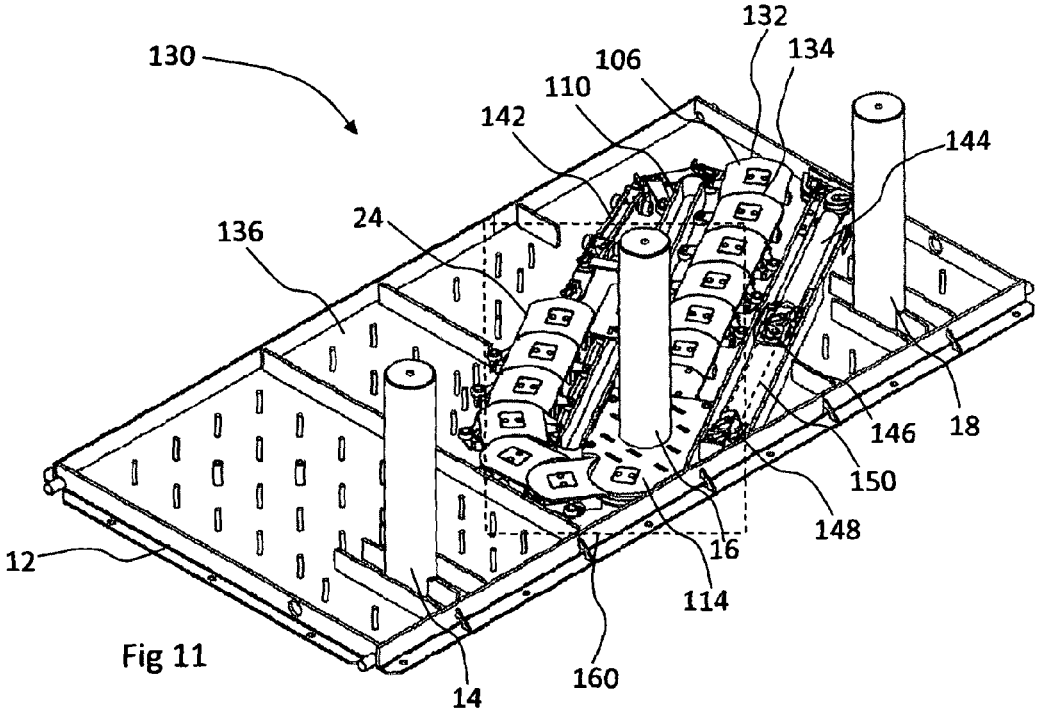
FIG. 11 shows a perspective view of a security barrier apparatus in a closed position according to another embodiment of the invention.
Figure 12:
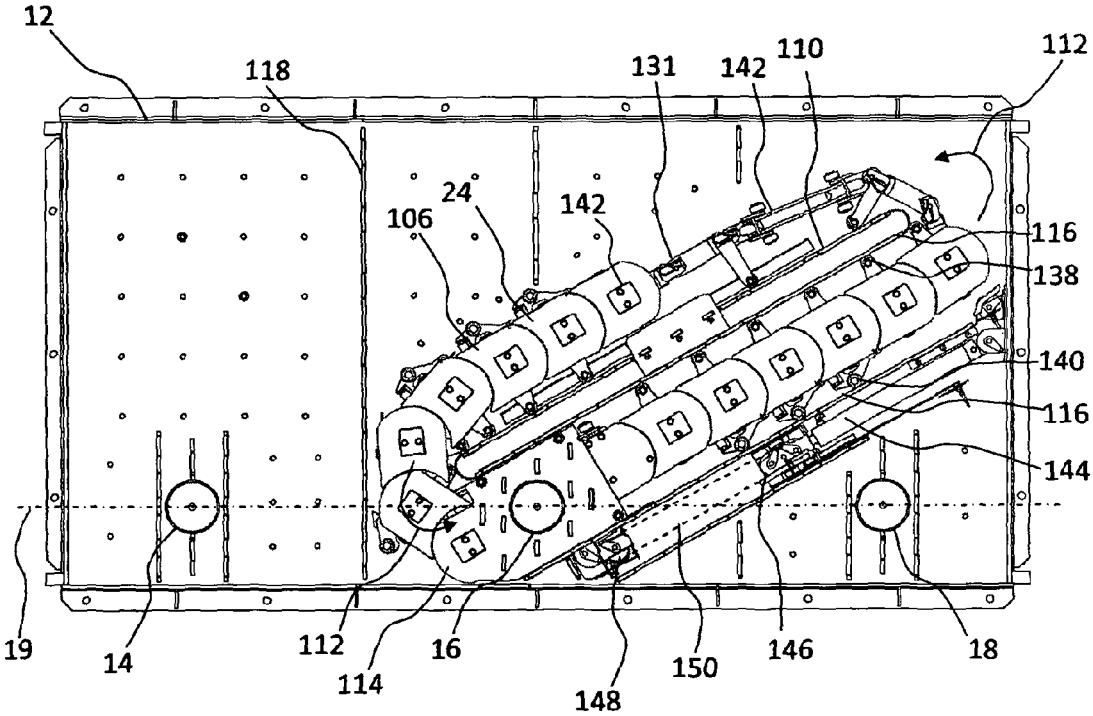
FIG. 12 shows a plan view of the security barrier apparatus shown in FIG. 11 in a closed position.

FIG. 11 shows a perspective view of a security barrier apparatus in a closed position according to another embodiment of the invention, generally designated 130. FIG. 12 shows a plan view of the security barrier apparatus shown in FIG. 11 in a closed position. In FIGS. 11 and 12 like features to the arrangements of FIGS. 1-10 are shown with like reference numerals. In FIGS. 11 and 12 the security barrier apparatus 130 is shown with the upper surface removed for the purposes of clarity so that an alternative arrangement for the slide device can be seen more easily. The slide device provides the translatable movement of the inner post 16 or 72. The slide device shown is an alternative arrangement for the belt 24, and comprises a plurality of substantially horizontal portions 106, which may alternatively be termed belt members or track members. The track members 106 are releasably connected to one another so that they form a continuous belt 24. The releasable connection may be provided by a pin and clip arrangement 131. The track members 106 are movable around the track 110. The track members 106 have upper plates which have front and rear edges 132, 134 such that a front edge 132 of one plate abuts a rear edge 134 of an adjacent plate. The front and rear edges 132, 134 are curved so that they cooperate with one another other so that the aperture 22 in the top surface 20 (not shown in FIGS. 11 and 12) remains substantially closed as the inner post 16 or 72 is moved between the open and the closed positions. It will be appreciated that the track members 106 form a plurality of links which are pivotably connected to one another, the pivotable connections having substantially vertical axes. The track 110 is fixed to the base 12 and comprises a loop so that the track members 106 are moveable thereon. The loop comprises two substantially straight sides which are closed by curved ends. Such an arrangement allows the track members 106 to move along the straight sides and to move in a curved manner around the ends of the loop as shown by the arrows 112. When the track members 106 move around the curved ends of the track 110 the front and rear edges 132, 134 of adjacent track members 106 remain in contact with each other, which assists with guiding the slide device around the track 110.

The plate 114 upon which the inner post 16 is mounted is also shown. The plate 114 may alternatively be termed a platform or a carriage. The plate 114 is linearly moveable on substantially parallel rails 116 so that the inner post 16 is movable in the aperture 22. The parallel rails 116 are fixed to the base 12. One of the parallel rails comprises a straight part of the track 110. The track members 106 are attached to the plate 114 on a front and rear side thereof so that as the inner post 16 is moved within the aperture 22 and the track members 106 close the aperture 22. Each track member 106 has two wheels underneath it which run on a lower plate 136 of the base 12, which permits each track member 106 to run freely on the lower plate 136 and to support the weight of a vehicle as it passes over the security barrier 130. Twelve track members 106 are shown, with six track members 106 on either side of the plate 114. Each track member 106 and the plate 114 have an inner side wheel 138, which run on the track 110. The plate 114 and some of the track members 106 also have an outer side wheel 140, which run on one of the parallel rails 116. It will be appreciated the plate 114 and some of the track members 106 have inner and outer side wheels 138, 140 on opposing sides thereof, and in the embodiment shown seven of the track members 106 have such opposing wheels. The opposing wheels help to guide the plate 114 and the track members 106 within the parallel rails 116. The opposing side wheels 138, 140 may be sprung loaded to bias the plate 114 and the track members 106 away from the parallel rails 116. Also shown in the upper plates of each track member 106 is a removable plate 142, which is flush fitting with the upper plate. The removable plates 142 may be used to inspect the track members 106. A plurality of reinforcing plates 118 are provided between the upper and lower parts of the base 12. The reinforcing plates 118 are substantially vertical and operate to strengthen the base 12 to resist deforming thereof when a vehicle drives on the upper surface 20.

A tensioning device 142 is also shown which has two wheels at a front part and two wheels at a rear part. The tensioning device 142 has a spring which operates to pull the two front wheels of the tensioning device 142 towards the two rear wheels. Front and rear parts of the tensioning device 142 are coupled to track members 106. The tensioning device operates to pull the belt 24 around the track 110 so that a gap between the inner side wheels 138 and the track 110 is reduced.

Also shown is a hydraulic actuator 144 to move the inner post 16 between the open and the closed positions. A pulley 146 is provided at an end of the hydraulic actuator 144, and three nested pulleys 148 are provided on the base 12. A cable 150 (e.g. 10 mm diameter steel rope) passes around the pulleys 146, 148 and is connected to the plate 114 which carries the inner post 16. When the hydraulic actuator 144 is operated a smaller movement thereof provides a larger movement of the plate 114. It will be appreciated that the movement ratio between the end of the hydraulic actuator 144 and the plate 114 is about 1:3. For example, if the inner post 16 travels 1.6 m between the open and closed positions, the end of the hydraulic actuator 144 travels 0.53 m. Such an arrangement has the advantage of amplifying the amount of linear travel of the end of hydraulic actuator 144 (i.e. a ram of the hydraulic actuator 144) so that the hydraulic actuator 144 can be shorter than would otherwise be the case without the arrangement of the pulleys 146, 148. An appropriate power source (not shown) is provided to operate the hydraulic actuator 144. The hydraulic actuator 144, the pulleys 146, 148 and the cable 150 comprise the drive device. It will be appreciated that the hydraulic actuator 144 operates to effectively lock the inner post 16 in situ at any position along the length of travel of the inner post along the parallel rails 116. This is due to the cable 150 connection between the hydraulic actuator 144 and the inner post 116, and the high force required to be exerted on the inner post 16 to move the ram of that the hydraulic actuator 144.

Figure 13:
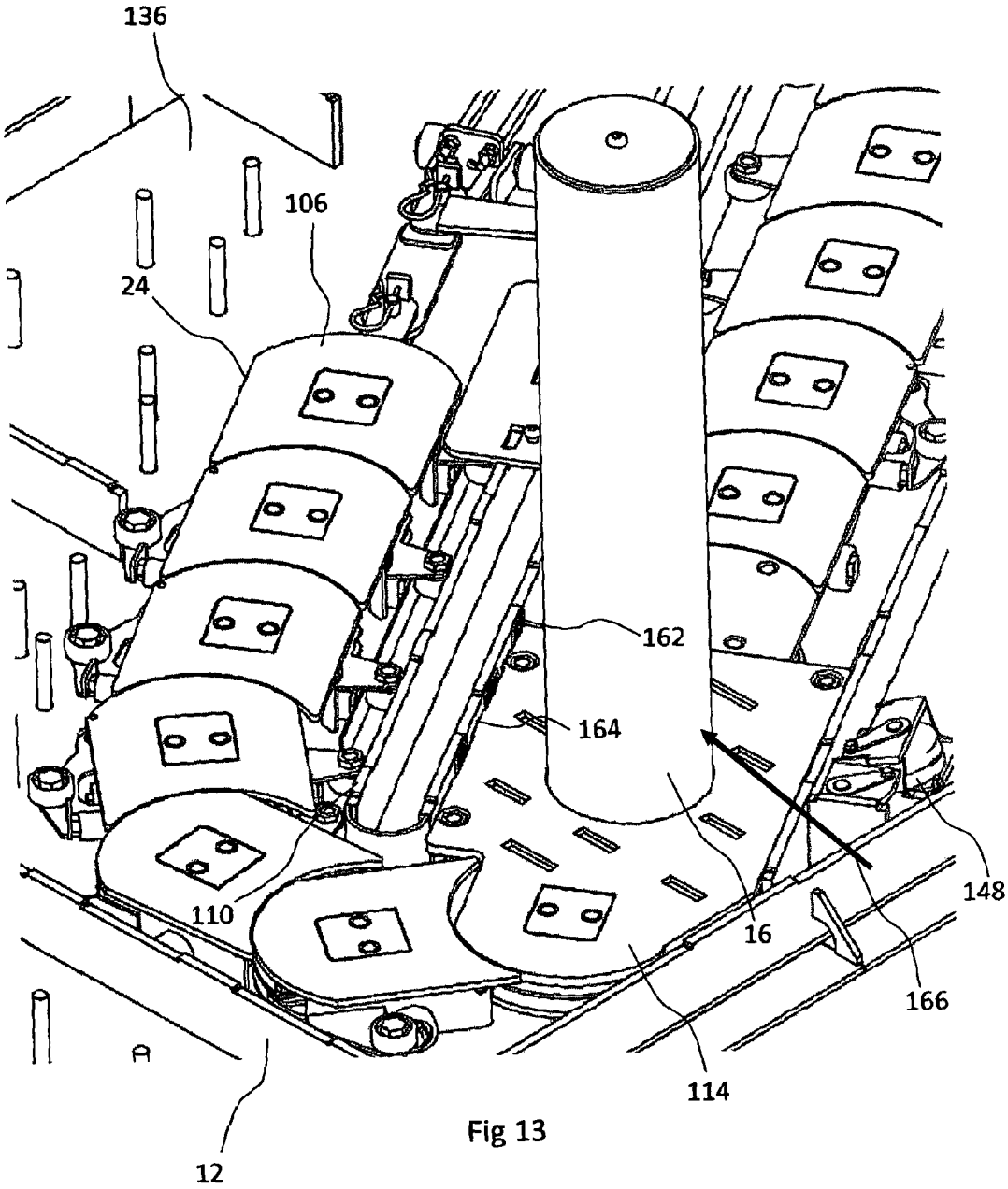
FIG. 13 shows a detail part of the security barrier apparatus shown in FIG. 11.

FIG. 13 shows a detail part 160 of the security barrier apparatus 130 shown in FIG. 11. In FIG. 13 like features to the arrangements of FIGS. 1-12 are shown with like reference numerals. In FIG. 13 the track 110 is shown to have a series of plates 162 welded to the side thereof. In FIG. 13 three plates 162 are shown, and it will be appreciated that there are additional plates welded to the side of the track 110 which are hidden by the inner post 16. The plates 162 form a series of engagements or teeth on the track 110. Corresponding engagements or teeth 164 are also provided at an edge of the plate 114 upon which the inner post 16 is mounted. The plates 162 may extend the full height of the track 110. A second plate (not shown) is also provided below the plate 114 and above the lower plate 136 of the base 12. Corresponding engagements or teeth 164 are also provided at an edge of the second plate. In the event of an impact by a vehicle indicated by arrow 166, the plate 114 is moved towards the track 110 so that the teeth 164 and the plates 162 engage one another, which inhibits the inner post 16 from moving out of the first plane 19, or along the elongate aperture 22. Such an arrangement provides an improved strength to the security barrier apparatus 130.

It will be appreciated the apparatus 10, 70, 100, 130 is a surface mounted device so that it can be mounted on the ground surface 52. In addition the base 12 is relatively shallow, being for example, 0.12 m above the ground surface 52 so that a vehicle can drive onto the upper surface 20. This means that the base 12 has a very low height but the apparatus 10, 70, 100, 130 is still a substantial bollard that may withstand a truck or lorry of about 7.5 tonnes that may be travelling at up to 30 mph. In addition the arrangement of the at least one inner post 16, 72 being translatably movable relative to the outer posts 14, 18 means that there is a reduced risk of trapping an item or a person between posts 14, 16, 18, 72 of the apparatus 10, 70, 100, 130. Furthermore, the arrangement of the ramps 26, 28 and the chamfered edge of the elongate aperture 22, 73 means that there is a reduced risk of a person tripping when walking on the apparatus 10, 70, 100, 130.

The apparatus 10, 70, 100, 130 may be arranged to be temporarily located on the ground surface 52 so that it is removable, or it may be permanently secured to the ground surface 52, for example by cementing it into the ground. Providing a temporary arrangement means that the apparatus 10, 70, 100, 130 may be considered to be a portable security barrier apparatus 10, 70, 100, 130. The apparatus 10, 70, 100, 130 may be configured as a high security barrier apparatus for anti-terrorist applications, or a relatively low security barrier apparatus to safeguard a driveway.

In the above description the inner posts 16, 72 are described as such in relation to their position relative to the outer posts 14, 18 in the closed position of the apparatus 10, 70, 100, 130. It will be appreciated that in the open position of the security barrier apparatus 10, 70, 100, 130 the inner posts 16, 72 may still be termed as such. The posts 14, 16, 18, 72 are substantially parallel with each other in the open and closed position of the apparatus 10, 70, 100, 130 and as the apparatus 10, 70, 100, 130 is operated between the open and the closed positions. It will also be appreciated that the posts 14, 16, 18, 72 are spaced apart from one another in the closed and the open positions of the apparatus 10, 70, 100, 130 and as the apparatus 10, 70, 100, 130 is operated between the open and the closed positions.

Whereas substantially vertical and straight posts 14, 16, 18 are shown in the above embodiments it will be appreciated that alternative shapes and configurations of the posts 14, 16, 18 may also be used.

In the above embodiments it will be appreciated that the first plane 19, the second plane 44 and the third plane 74 correspond to the upright posts 14, 16, 18, 72 which define the planes. The planes may be substantially upright planes 19, 44, 74 such that they are normal to the base 12 or the ground. Alternatively the planes 19, 44, 74 may be inclined relative to the normal.

The invention claimed is:

1. A security barrier apparatus, comprising a support having at least three upright posts thereon, two of the posts being fixed to the support and at least one post being translatably movable relative to the two fixed posts, the two fixed posts being spaced apart from one another and defining a first plane therebetween, the movable post being mounted to a slide device of the support for providing said translatable movement, wherein the slide device includes a belt or track to operate the movable post, the belt or track being arranged to move in a horizontal plane to operate the apparatus between an open position and a closed position such that in the closed position the movable post is between the fixed posts for inhibiting the passage of a vehicle, and in the open position the movable post is out of alignment with the first plane and adjacent to one of the fixed posts for allowing the passage of a vehicle therebetween.

2. A security barrier apparatus according to claim 1, wherein in the closed position of the apparatus the movable post is substantially aligned with the fixed posts within the first plane.

3. A security barrier apparatus according to claim 1, the movable post and said one of the fixed posts defining a second plane therebetween, wherein in the open position of the apparatus an angle between the first plane and the second plane is greater than or equal to 90°.

4. A security barrier apparatus according to claim 1, wherein the movable post is spaced apart from said one of the fixed posts in the open position of the apparatus.

5. A security barrier apparatus according to claim 1, wherein the support has an upper surface for a vehicle.

6. A security barrier apparatus according to claim 5, wherein the upper surface has an elongate aperture in which the movable post is translatably movable between the open and the closed positions.

7. A security barrier apparatus according to claim 1, wherein the belt or track is arranged to close the elongate aperture as the apparatus is operated between the open and closed positions.

8. A security barrier apparatus according to claim 1, wherein the slide device further comprises a platform upon which the movable post is mounted, the platform being movable relative to the support.

9. A security barrier apparatus according to claim 1, and further including a drive device to provide said translatable movement of the movable post relative to the fixed posts.

10. A security barrier apparatus according to claim 1, wherein the at least one post includes two movable posts being translatably movable relative to the two fixed posts, each movable post being mounted to a respective slide device of the support for providing said translatable movement, the slide devices to operate the apparatus between the open position and the closed position such that in the closed position the two movable posts are between the fixed posts for inhibiting the passage of a vehicle, and in the open position the movable posts are out of alignment with the first plane and adjacent to a respective fixed post for allowing the passage of a vehicle therebetween.

11. A security barrier apparatus according to claim 1, wherein the belt or track further comprises a plurality of belt or track members.

12. A security barrier apparatus, comprising a support having at least three upright posts thereon, two of the posts being fixed to the support and at least one post being translatably movable relative to the two fixed posts, the two fixed posts being spaced apart from one another and defining a first plane therebetween, the movable post being mounted to a slide device of the support for providing said translatable movement, the slide device including a platform upon which the movable post is mounted, the platform being movable relative to the support, the platform having a plurality of belt or track members attached thereto, the slide device to operate the apparatus between an open position and a closed position such that in the closed position the movable post is between the fixed posts for inhibiting the passage of a vehicle, and in the open position the movable post is out of alignment with the first plane and adjacent to one of the fixed posts for allowing the passage of a vehicle therebetween.

13. A security barrier apparatus according to claim 12, wherein the plurality of belt or track members are attached to the platform with a chain.

14. A security barrier apparatus according to claim 13, wherein the plurality of belt or track members are arranged to close the elongate aperture as the apparatus is operated between the open and closed positions.

15. A method of operating a security barrier apparatus comprising a support having at least three upright posts thereon, two of the posts being fixed to the support and at least one post being translatably movable relative to the two fixed posts, the two fixed posts being spaced apart from one another and comprise a first plane therebetween, wherein the support has an upper surface for a vehicle and the upper surface has an elongate aperture in which the movable post is translatably movable, the method including:

operating the apparatus between a closed position where the at least one movable post is between the two fixed posts for inhibiting the passage of a vehicle, and an open position where the at least one movable post is out of alignment with the first plane and adjacent to one of the fixed posts for allowing passage of a vehicle therebetween, and closing the elongate aperture as the apparatus is operated between the open and the closed positions.

16. A method according to claim 15, and further including operating the apparatus so that the movable post is substantially aligned with the fixed posts within the first plane in the closed position of the apparatus.

17. A method according to claim 15, the movable post and said one of the fixed posts comprising a second plane therebetween, the method including operating the apparatus so that an angle between the first plane and the second plane is greater than or equal to 90° in the open position.

18. A method according to claim 15, and further including operating the apparatus so that the movable post is spaced apart from said one of the fixed posts in the open position.

19. A method according to claim 15, wherein the security barrier apparatus further includes two movable posts, which are translatably movable relative to the two fixed posts, the method including operating the apparatus between a closed position where the two movable posts are between the two fixed posts for inhibiting the passage of a vehicle, and an open position where the two movable posts are out of alignment with the first plane and adjacent to a respective fixed post for allowing passage of a vehicle therebetween.

* * * * *